United States Patent [19]

Dwyer

[11] Patent Number: 4,991,237

[45] Date of Patent: Feb. 12, 1991

[54] HONEYCOMED EXPANDABLE HAT

[76] Inventor: Kevin Dwyer, 1478 Main St., South Weymouth, Mass. 02190

[21] Appl. No.: 385,806

[22] Filed: Jul. 26, 1989

[51] Int. Cl.[5] ..... A42B 1/00

[52] U.S. Cl. ..... 2/209.7

[58] Field of Search ..... 2/209, 171, 171.3, 175, 2/177, 209.7, 171.4, 171.5

[56] References Cited

U.S. PATENT DOCUMENTS

| | | | |
|---|---|---|---|
| 1,996,254 | 4/1934 | Parlow | 2/209.7 |
| 2,864,092 | 12/1958 | Hurst | 2/177 |
| 3,169,251 | 10/1961 | Humes, Jr. | 2/177 |
| 4,517,685 | 5/1985 | Lesley | 2/171 X |

FOREIGN PATENT DOCUMENTS

| | | | |
|---|---|---|---|
| 486634 | 4/1918 | France | 2/175 |

*Primary Examiner*—Daniel P. Stodola
*Assistant Examiner*—John P. Darling
*Attorney, Agent, or Firm*—M. Lawrence Oliverio

[57] ABSTRACT

A method of using a single self-supporting, resilient, expandable, contoured tube to form either of two possible hat configurations; the tube having a honeycombed expandable configured encircling wall defining first and second head receiving openings toward respective first and second ends of the wall and spaced along a defined length of the wall; the wall being configured along its length so as to define a first configuration towards the first opening different than a second configuration toward the second opening; the method comprising: selecting one of the first and second openings to be pulled over the head of a user; and pulling the selected opening over the head of the user for a portion of the length of the tube while expanding the portion to form a first hat configuration an appearance different from an appearance and configuration formed when the second opening is pulled over the head of the user and expanded.

7 Claims, 2 Drawing Sheets

HONEYCOMED EXPANDABLE HAT

BACKGROUND OF THE INVENTION

The present invention relates to expandable hats and, more particularly, to expandable structures which can be inverted in orientation for use as a hat having different self-supporting configurations.

Expandable hats such as stocking caps have been known for many years. Paper hats having various designs and configurations have also been used in the past. Honeycombed structures which are expandable and resiliently contractible have also been constructed and used in the past and, in particular, a honeycombed structure such as shown and described with reference to FIG. 1 has been used in the past as a vase for holding dry flowers.

The present invention provides a novel use for expandable, self-supporting, configured structures which can be used to form at least two substantially different hat design configurations and particularly as invertible hats. Headwear products such as described in U.S. Pat. Nos. 3,811,130 (Townsend), 3,187,345 (Holford), 2,437,525 (Harrel), 2,335,070 (Luhrs), 1,996,254 (Perlow), 995,990 (Stern) and 1,743,432 (Conklin) have been devised for novelty, decorative, ventilation and other purposes but do not provide the novel features and uses of the present invention.

SUMMARY OF THE INVENTION

In accordance with the invention there is provided a method of using a single self supporting, resilient, expandable, contoured tube to form either of two possible hat configurations; the tube having a honeycombed expandable configured encircling wall defining first and second head receiving openings toward respective first and second ends of the wall and spaced along a defined length of the wall; the wall being configured along its length so as to define a first configuration towards the first opening different than a second configuration toward the second opening; the method comprising: selecting one of the first and second openings to be pulled over the head of a user; and pulling the selected opening over the head of the user for a portion of the length of the tube while expanding the portion to form a first hat configuration and appearance different from an appearance and configuration formed when the second opening is pulled over the head of the user and expanded.

The step of pulling typically comprises: positioning the selected one of the openings over the head of the user; expanding the selected opening to a degree sufficient to accommodate insertion of the head into the expanded opening; inserting the head into the expanded opening; and allowing the walls of the tube surrounding the inserted head to resiliently engage the inserted head.

Further in accordance with the invention there is provided a method of using a single self-supporting, resilient, expandable, contoured tube formed of a plurality of strips joined together forming a honeycombed structure to form a decorative hat configuration; the tube having at least one open end defining a head receiving opening and an elongated expandable encircling wall defining an outer configuration; the method comprising: positioning the encircling wall adjacent the head of a user; and expanding the wall and pulling the opening over the head to define a configured decorative hat with an expanded form of the honeycomb surrounding a portion of the head.

Alternatively there is provided a method of using a tubular, resiliently expandable honeycombed wall structure having a configuration comprising: a bulbous portion and a conical portion separated by a neck portion, the bulbous portion terminating in a first expandable aperture and the conical portion terminating in a second expandable aperture; the method comprising: selecting one of the apertures; positioning the selected aperture over the head of the user; expanding the aperture to a degree sufficient to accommodate insertion of the head into the aperture; inserting the head into the expanded aperture and allowing the expanded walls of the structure to resiliently engage the inserted head.

There is also provided an open-ended annular expandable structure formed of a plurality of elongated lengths of sheet material joined together at spaced locations to form a resiliently expandable array of honeycomb cells which may be expanded at at least one end for use as a hat wherein the one end may be expanded to fit about heads of various sizes.

Most preferably the expandable structure has a bulbous configuration at one end and a conical configuration at another end, the bulbous and conical configurations being joined by a neck portion. The structure is typically open at both ends, both open ends being expandable to fit about heads of various sizes.

Typically the elongated lengths of sheet material comprise strips of paper, the strips of paper being arranged sequentially face to face, immediately adjacent strips being adjoined at serially spaced locations along the lengths of the strips.

Most preferably the structure includes an expandable and resiliently contractible band fitted around the bulbous portion of the structure for preserving the resiliency of the honeycomb cells.

DETAILED DESCRIPTION OF PREFERRED EMBODIMENTS

Figure 1:
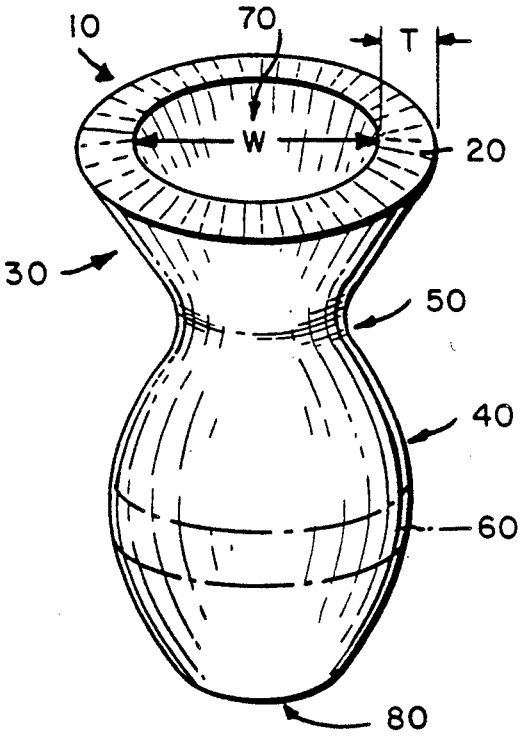
FIG. 1 is a front isometric view of a configured tubular expandable hat structure according to the invention showing the structure having a conical end and a bulbous end with its open conical end in an upward orientation.
Figure 2:
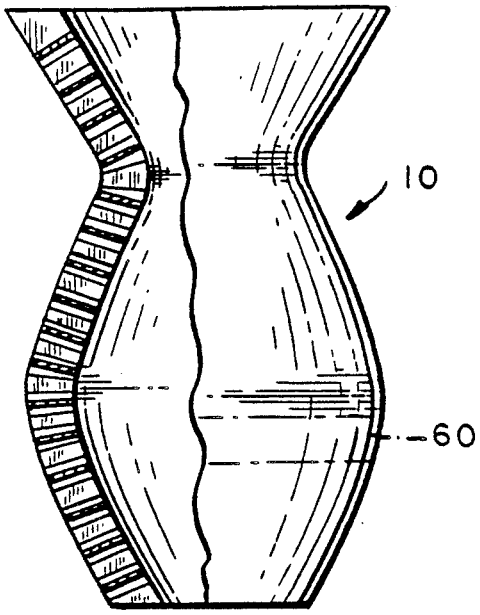
FIG. 2 is a partial cross-sectional view of the structure of FIG. 1.

FIG. 1 illustrates an isometric view of an expandable hat 10 according to the invention. The hat 10 comprises an annular wall 20 having a thickness T of typically between about 0.2 and about 1.2 inches. The wall 20, is shown in annular connected form in FIGS. 1–5 and is shown in straight disconnected form in FIG. 6. As shown in FIG. 6 before the wall 20 is connected or adjoined from end 22 to end 24, the wall is configured from top 26 to bottom 28, typically by conventional milling, sawing, lathing or the like, into a predetermined curvilinear shape. As shown in FIG. 6 a preferred curvilinear shaping comprises a semi-flattened S-like curve. This particular shaping results in the preferred structure 10, FIGS. 1, 4, having a bulbous end portion 40 and a conical-like end portion 30 which are adjoined by a neck 50 when the ends 22, 24, of the wall 20, FIG. 6, are adjoined.

Figure 6:
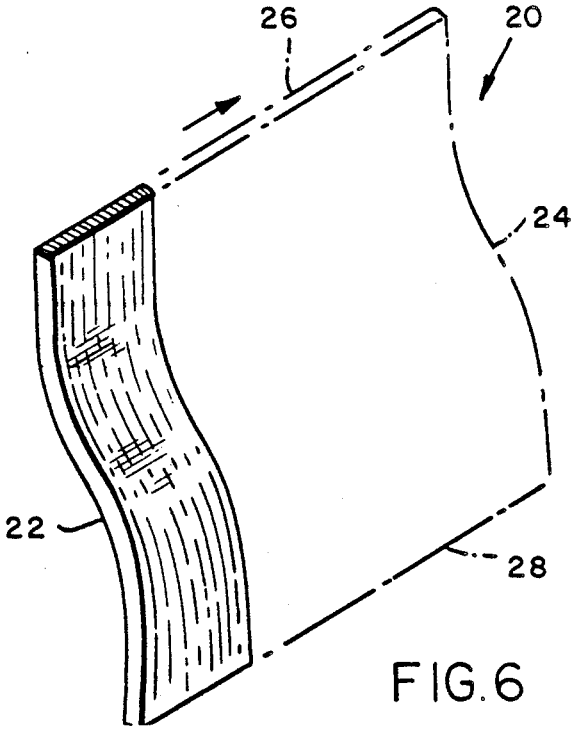
FIG. 6 is a side isometric view of the configured annular wall which forms the self-supporting wall structure of the FIGS. 1 and 4 hat structures showing the wall disconnected; and, FIG. 7 is a close up isometric detail view of a portion of the FIG. 6 wall structure showing the honeycomb cell substructure of the wall structure.
Figure 7:
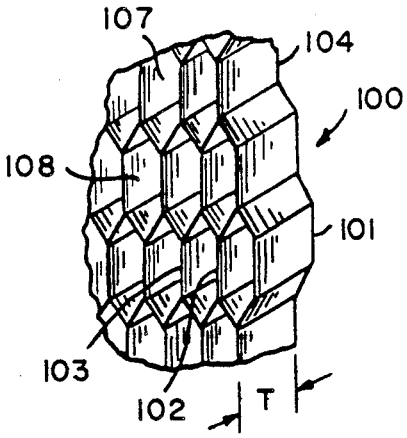

As shown in FIG. 7 the substructure of the wall 20 comprises a honeycomb 100 having honeycomb-like cells, e.g. 107, 108. The honeycomb 100 and the wall 20 as a whole, is formed of a plurality of flat strips, e.g. 101, 102, 103, having a width T, FIG. 1, and a length from top 26 to bottom 28 of typically between about 6 and about 12 inches. The plurality of strips, e.g. 101, 102, 103, FIG. 7, are arranged serially in face to face relationship, and immediately adjacent strips are adjoined from top 26 to bottom 28 at spaced locations, e.g. 104, to form a honeycomb 100 structure. The strips preferably comprise a paper material, typically a somewhat stiff paper such as a relatively thin cardboard material having a width T. When such a material is used to comprise the strips of the honeycomb 100, FIG. 7, the overall wall 20 is self-supporting and the honeycomb 100 (shown expanded in FIG. 7) is expandable and resiliently contractible by virtue of the relative stiffness of the paper strips, e.g. 101, 102, 103, and the spaced connections between immediately adjacent strips. Typically the spacing between the centers of the positions where the strips are adjoined is between about 0.5 and about 2.5 inches, although the exact spacing will vary depending on the stiffness of the paper strips selected and the degree of expandability and contractibility desired in the annular structure 10, FIGS. 1, 4, as well as the size of the openings 70, 80 and the neck portion 50 of the structure 10 as more fully described below. As shown in partial cross-section of the connected annular structure 10, FIG. 2, when the ends 22, 24, FIG. 6, are connected to form the annular wall structure 10, the top to bottom cross-sectional configuration of the wall 20 is the same as shown in FIG. 6.

Figure 3:
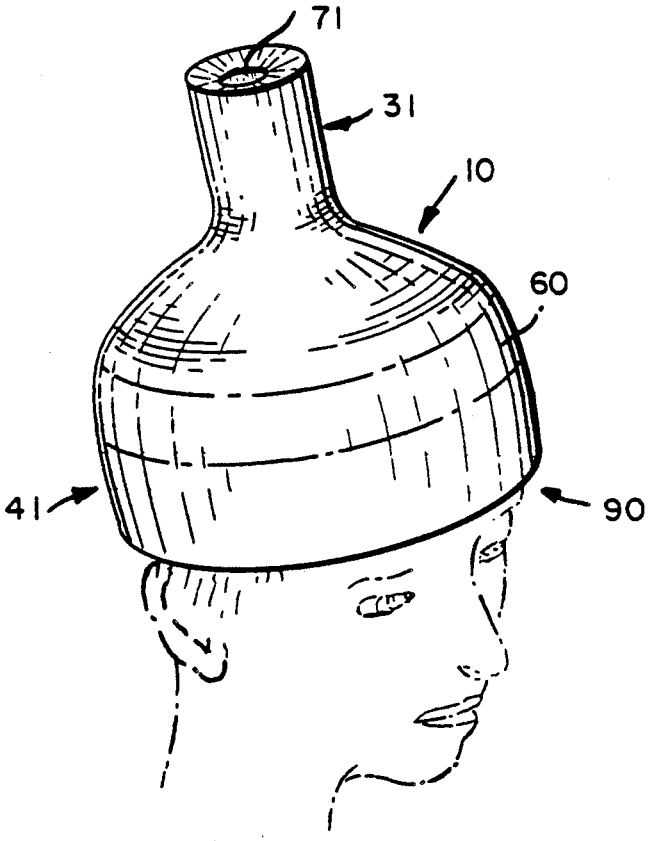
FIG. 3 is an isometric view of the FIG. 1 structure showing the configuration of the structure when the open bulbous end is expanded and fitted over the head of a user.

As shown in FIG. 3, the hat structure 10 can assume a first overall hat configuration whereby the open end 80 at the terminal end of the bulbous portion 40 is expanded to a degree sufficient to fit over a user's head 90. The resiliency of the honeycombed structure 100 of the hat 10 contracts the expanded opening 80 and grasps the user's head 90 such that the hat 10 remains seated on the user's head 90. As shown, the original opening 70, FIG. 1, at the terminal end of the conical portion 30, substantially contracts to a smaller opening 71, the portion 30 contracts into an almost cylindrical configuration 31 and the bulbous portion 40 expands into an inverted bowl like configuration 41, FIG. 3.

Figure 4:
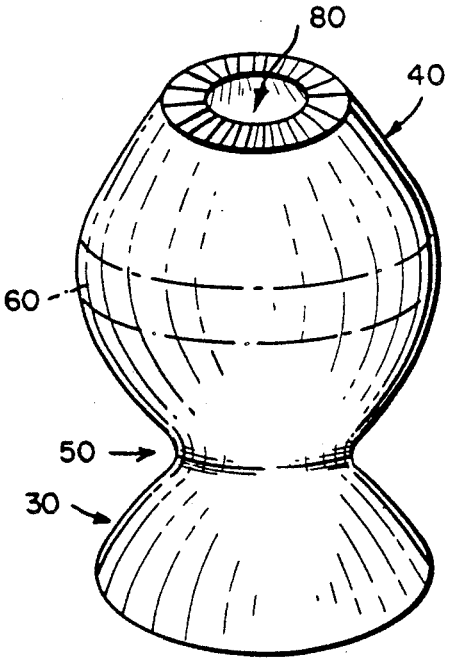
FIG. 4 is a front isometric view of the FIG. 1 hat structure showing the structure with its open bulbous end in an upward orientation.
Figure 5:
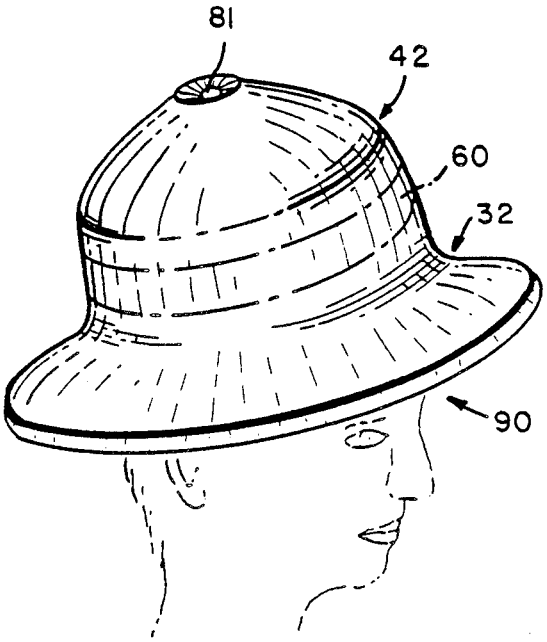
FIG. 5 is an isometric view of the FIG. 4 structure showing the configuration of the structure when the open conical end is expanded and fitted over the head of a user.

As shown in FIGS. 4, 5, the same hat structure 10 when inverted can assume a second overall hat configuration whereby the open end 70 at the terminal end of conical portion 30 is expanded to a degree sufficient to fit over a user's head 90, FIG. 5. Again, the resiliency of the honeycombed substructure 100 of the hat 10 contracts the expanded opening 70 and grasps the user's head 90 such that the hat 10 remains seated on the user's head 90. As shown, the original opening 80, FIG. 4, contracts to a smaller opening 81, the bulbous portion 40 assumes a bowl-like shape 42, and the conical portion 30 assumes a fan-like rim configuration 32, FIG. 5. When the structure 10, FIG. 4, is expanded to the configuration shown in FIG. 4, the neck 50 is substantially expanded also, and typically, the user's head 90 is grasped by the inside of the neck 50 which also resiliently contracts upon expansion around the user's head 90, FIG. 5.

As shown in FIGS. 1, 4, when the structure 10 is in its unexpanded/uncontracted or relaxed state, the width W, of the open end 70 is relatively much wider than the width of the open end 80. Typically, in its relaxed state the width W is between about 3 and about 6 inches and the width of opening 80 is between about 0.5 and about 1.5 inches. Although the specific embodiments specifically demonstrate conical-like 30 and bulbous 40 configurations for the structure 10, other separate configurations may be utilized along the length of the structure depending on the ultimate hat configurations desired when the structure is expanded to fit over the head.

In a preferred embodiment, the hat 10 is provided with an elastic, i.e. expandable and resiliently contractible, band 60 shown in outline form in FIGS. 1, 2, 3, 4 and 5. The band 60 is typically fitted around the bulbous portion 40 initially and when the structure is expanded into the configurations shown in FIGS. 3 and 5 serves to supplement the resilient contractibility of the honeycombed substructure 100. Inasmuch as the honeycombed substructure 100 will, over time and continued usage, tend to lose some of its resiliency, the band 60 further acts to preserve and extend the resiliency life of the honeycombed structure 100. The band 60 may comprise any suitable resiliently elastic material such as commercially available rubbers, plastics and the like. The degree of elasticity and resiliency of the band 60 will vary depending on the size and configuration of the hat 10 desired, it being recognized that the degree of elasticity/resiliency of the band 60 is selected to allow convenient expansion of the ends 70, 80 and the neck 50 by a user while simultaneously providing relatively long lasting elasticity/resiliency and comfortable snug fitting of the hat configurations, FIGS. 3, 5, around the head 90. In practice, it has been found that the elastic band portion found in commercially available women's panty hose may be suitable for use as a band 60. The band 60 is also useful for purposes of bearing written phrases, words, logos and the like thereon especially where the hat 10 may be used as a novelty item, e.g. at sporting and entertainment events whereat slogans or the names of the teams, entertainers and the like might be printed on the band 60.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An open-ended annular expandable structure formed of a plurality of elongated lengths of sheet material joined together at spaced locations to form a resiliently expandable array of honeycomb cells which may be expanded at at least one end for use as a hat wherein the one end may be expanded to fit about heads of various sizes, wherein the structure has a bulbous configuration at one end and a conical configuration at another end, the bulbous and conical configurations being joined by a neck portion.

2. The expandable structure of claim 1 wherein the structure is open at both ends, both open ends being expandable to fit about heads of various sizes.

3. The expandable structure of claim 2 wherein the use of the structure as a hat comprises expanding either of a selected one of the open ends of the structure to a degree sufficient to fit over a user's head, the other open end of the structure contracting as the one selected open end is expanded.

4. The expandable structure of claim 1 wherein the structure includes an expandable and resiliently contractible band fitted around the bulbous configuration of the structure for preserving the resiliency of the honeycomb cells.

5. An open-ended annular expandable structure formed of a plurality of elongated lengths of sheet material joined together at spaced locations to form a resiliently expandable array of honeycomb cells which may be expanded at at least one end for use as a hat wherein the one end may be expanded to fit about heads of various sizes, wherein the elongated lengths of sheet material comprise strips of paper, the strips of paper being arranged sequentially face to face, immediately adjacent strips being adjoined at serially spaced locations along the lengths of the strips, and wherein the structure has a bulbous configuration at one end and a conical configuration at another end, the bulbous and conical configurations being joined by a neck portion.

6. The expandable structure of claim 5 wherein the structure is open at both ends, both open ends being expandable to fit about heads of various sizes.

7. The expandable structure of claim 5 wherein the structure includes an expandable and resiliently contractible band fitted around the bulbous configuration of the structure for preserving the resiliency of the honeycomb cells.

* * * * *